US006908398B1

(12) United States Patent
Kang

(10) Patent No.: US 6,908,398 B1
(45) Date of Patent: Jun. 21, 2005

(54) AUTOMATIC SWING DEVICE

(75) Inventor: Soon-Dong Kang, Gyeonggi-do (KR)

(73) Assignee: Kukutoys Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/782,791

(22) Filed: Feb. 23, 2004

(30) Foreign Application Priority Data

Jan. 5, 2004 (KR) ..... 10-2004-0000270

(51) Int. Cl.[7] ..... A63G 9/16
(52) U.S. Cl. ..... 472/119; 5/105
(58) Field of Search ..... 472/118–125; 5/105–109

(56) References Cited

U.S. PATENT DOCUMENTS 1,727,635 A * 9/1929 Crane ..... 5/109
3,261,032 A * 7/1966 Reardon ..... 5/108
3,842,450 A * 10/1974 Pad ..... 5/109
3,849,812 A * 11/1974 Walsh ..... 5/108
4,730,176 A * 3/1988 Matsuo et al. ..... 335/230
5,048,135 A * 9/1991 Chen ..... 5/109
5,174,035 A * 12/1992 Yamazaki ..... 33/395
5,307,531 A * 5/1994 Kao ..... 5/108
5,608,366 A * 3/1997 Sako ..... 335/78
6,692,368 B1 * 2/2004 Hyun ..... 472/119

* cited by examiner

*Primary Examiner*—Kien Nguyen
(74) *Attorney, Agent, or Firm*—Dickstein Shapiro Morin & Oshinsky LLP

(57) ABSTRACT

A swing device has a supporter, a seat suspended on the supporter to swing in front and back directions, a permanent magnet installed in the seat, and an electromagnet installed to face the permanent magnet in a swing path to have the same polarity as that of the permanent magnet. The electromagnet is selectively driven when the permanent magnet approaches, generating a repulsive force for the permanent magnet. The seat swings by the repulsive force. The swing device has merits in that its simple structure makes manufacturing cost reduced and that a fixed polarity of the electromagnet prevents a malfunction of the device.

5 Claims, 3 Drawing Sheets

AUTOMATIC SWING DEVICE

CROSS-REFERENCE TO RELATED APPLICATIONS

This application claims the benefit of Korean Patent Application No. 2004-270 filed on Jan. 5, 2004, in the Korean Intellectual Property Office, the disclosure of which is incorporated herein by reference.

BACKGROUND OF THE INVENTION

1. Field of the Invention

The present invention relates to a swing device such as a swing or a cradle and so on, and more particularly to an automatic swing device capable of automatically swing using electromagnetic force.

2. Description of the Prior Art

Generally, a swing device such as a swing or a cradle and so on moving front and back has been widely used in order for a good sleep or a play for a baby. Particularly, recently, an automatic swing device has been developed which automatically swings using an external power.

Such automatic swing device is classified into an electromotor type and an electromagnetic type in accordance with a driving manner thereof, wherein the electromotor type is swung in such a manner that a pivot of the cradle or swing is directly driven by a motor, and the electromagnetic type is swung in such a manner that the cradle or swing is driven with a repulsive force acting between a permanent magnet and an electromagnet.

The electromotor type swing device has a drawback in that an operational noise is generated and power consumption is large because it is driven by a motor.

Meanwhile, a conventional electromagnetic type swing device is provided in which a permanent magnet is disposed in a seat on which a baby is seated, an electromagnet is disposed at front and back sides in a pivot direction of the seat, and a photo sensor detects a pivot angle of the seat to selectively change a polarity of the electromagnet, whereby the seat is swung front and back by a repulsive force acting between the permanent magnet and the electromagnet.

That is, when the permanent magnet approaches the electromagnet, the polarity of the electromagnet is changed into the same one as that of the permanent magnet to provide repulsive force between the permanent magnet and the electromagnet, so that the seat is swing in opposite direction by the repulsive force.

However, such electromagnetic type swing device has problems in that a structure is complicated and in that, if the photo sensor detects a wrong position of the seat, the polarity of the electromagnet is changed opposite to that of the permanent magnet so that a malfunction is possibly generated in which the seat is fixed on that position.

SUMMARY OF THE INVENTION

The present invention has been made to solve the above-mentioned problems occurring in the prior art, and an object of the present invention is to provide an electromagnetic type swing device having a simple structure and operating without malfunction.

The above object is accomplished by providing a swing device comprising, a supporter; a seat suspended on the supporter to swing in front and back directions; a permanent magnet installed in the seat; and an electromagnet installed to face the permanent magnet in a swing path to have the same polarity as that of the permanent magnet, wherein the electromagnet is selectively driven when the permanent magnet approaches, generating a repulsive force for the permanent magnet.

The electromagnet includes an iron core, a primary coil wound around the iron core, a power source for supplying electric current to the primary coil, and a switching unit disposed between the primary coil and the power source so as to selectively interrupt current supply from the power source to the primary coil.

The electromagnet can further include a secondary coil for generating induced current when the permanent magnet approaches so as to operate the switching unit.

The secondary coil has both ends wherein one end diverges into two portions each connected with the primary coil and the switching unit and the other end is connected with the power source whereby the induced current in the secondary coil flows in the switching unit to operate the same.

Preferably, the permanent magnet is installed in a central position under the seat, and the electromagnet is fixedly installed directly under the permanent magnet to face the same with a certain distance.

Preferably, the permanent magnet and the electromagnet are spaced apart with each other by a certain distance in the swing direction when the seat is positioned in a center position of a swing trajectory, so as to facilitate an initial driving of the seat.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, the preferred embodiment of the present invention will be described in greater detail with reference to the accompanying drawings.

Figure 1:
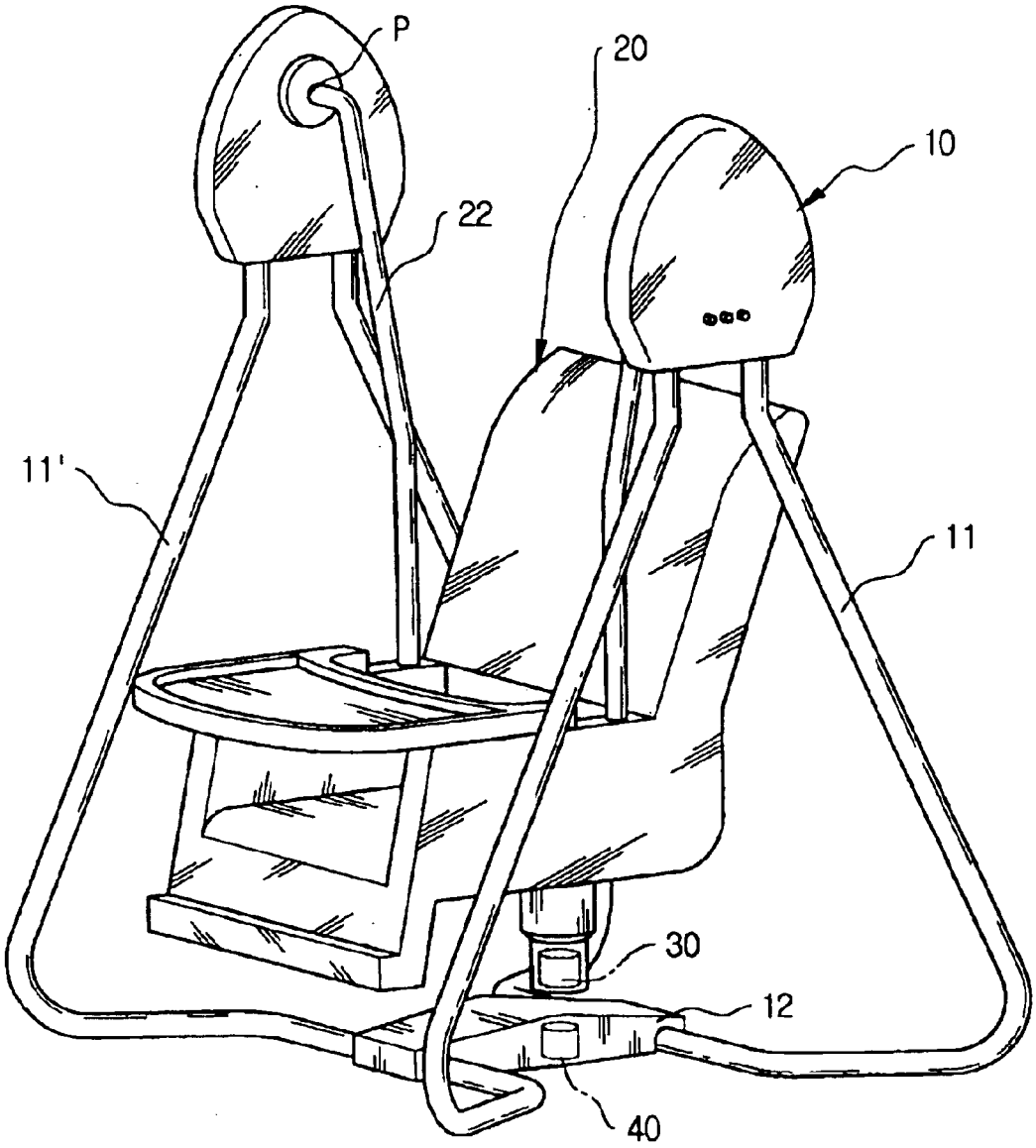
FIG. 1 is a perspective view of a swing device according to one embodiment of the present invention.

FIG. 1 is a perspective view of a swing device according to one embodiment of the present invention.

As shown in FIG. 1, a swing device of the present invention includes a supporter 10 and a seat 20 suspended on the supporter to swing in a front and back direction of the supporter. Particularly, the supporter 10 has a pair of triangular frames 11 and 11' opposite to each other with a certain distance, and a supporting portion 12 connecting lower portions of the frames 11 and 11'. The seat 20 is swingingly connected to the upper portions of the frames 11 and 11' by a pair of bars 22. That is, the lower portions of the bars 22 are coupled with the seat 20 and the upper portions of the bars 22 are rotatably coupled with the upper portions of the frames 11 and 11' so that the seat 20 can be swung in the front and back side directions about centers of gyration P on the upper portions of the bars 22.

Meanwhile, a permanent magnet 30 is installed on the bottom face of the seat 20, and an electromagnet 40 is installed on the supporting portion 12 directly downward from the permanent magnet 30. The electromagnet 40 and permanent magnet 30 are opposed to each other while having the same polarities so that a repulsive force is generated between the electromagnet 40 and the permanent magnet 30. The repulsive force makes the seat 20 swung in the front and back directions.

Figure 2:
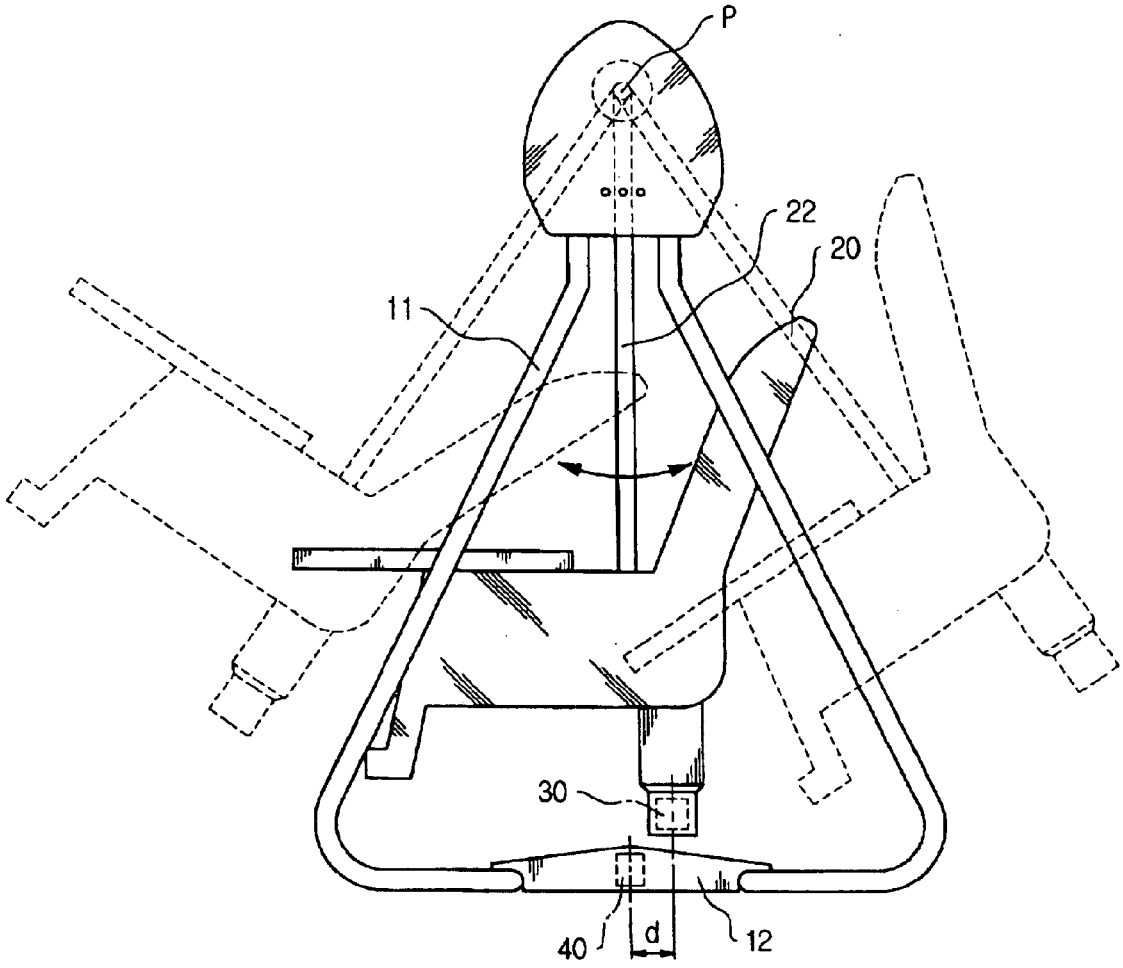
FIG. 2 is a side view of the swing device of FIG. 1.

Preferably, the permanent magnet 30 and the electromagnet 40, as shown in FIG. 2, are disposed spaced apart to each other by a distance d in the swing direction (front and back directions) when the seat 20 is positioned at a center portion. This is because the seat 20 can be easily moved by repulsive force between the permanent magnet 30 and the electromagnet 40 at it initial swing motion.

Meanwhile, when the permanent magnet 30 approaches, the electromagnet 40 is selectively operated only when the seat 20 passes a center position of the swing motion.

Figure 3:
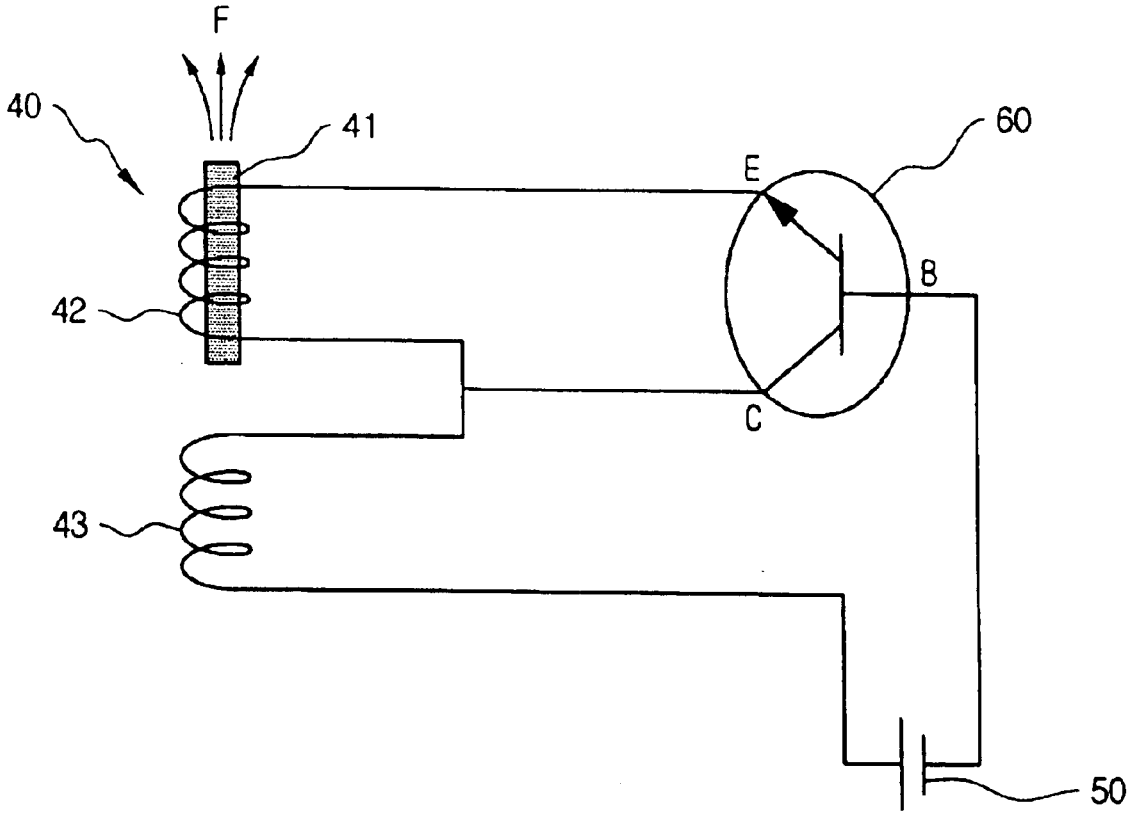
FIG. 3 is a circuit diagram for driving an electromagnet of the swing device according to the present invention.

FIG. 3 is a circuit diagram for driving the electromagnet of the swing device according to the present invention.

As shown in FIG. 3, the electromagnet 40 is formed such that a primary coil 42 is wound around an iron core 41. One end of the primary coil 42 is electrically connected with one polarity (for example, (−) polarity) of a power source 50 through a transistor 60, and the other end is electrically connected with the other polarity (for example, (+) polarity) of the power source 50 through a secondary coil 43.

The transistor 60 serves as a switching unit for selectively supplying or interrupting current supply from the power source 50 to the primary coil 42. To this end, the primary coil 42 is connected to an emitter side E of the transistor 60 and the secondary coil 43 is connected to a collector side C of the transistor 60. Particularly, one end of the secondary coil 43 diverges into two portions respectively connected with the primary coil 42 and the collector C of the transistor 60, and the other end of the primary coil is connected with the power source 50.

On/off operation of the transistor 60 is performed by the secondary coil 43. That is, since the permanent magnet 30 approaches the secondary coil 43 when the seat 20 passes the center position of the swing motion, induced current is generated on the secondary coil 43 by an electromagnetic induction. Then, the induced current applied to the secondary coil 43 makes the transistor 60 on so that current flows from the power source 50 to the primary coil 42 to operate the electromagnet 40, thus generating repulsive force F from the upper portion of the electromagnet 40 opposite to the permanent magnet 30.

Meanwhile, when the seat passes away the center position, the permanent magnet 30 is also away from the electromagnet, so that induced current applied to the secondary coil 43 is consumed, which makes the transistor 60 off to interrupt current supply from the power source 50.

Like this, the electromagnet 40 is selectively operated only when the permanent magnet 30 approaches, reducing unnecessary power consumption.

Meanwhile, although the power source 50 adapts 5–24V in this embodiment of the present invention, voltage of the power source 50 can be regulated to regulate the electromagnetic force of the electromagnet 40, regulating the swing width of the seat 20.

As described before, the swing device of the present invention swings the seat using repulsive force between the permanent magnet installed under the seat and the electromagnet installed directly under the permanent magnet, so that its simple structure makes a manufacturing cost reduced.

Also, according to the present invention, since the polarity of the electromagnet can be continuously fixed without changing the polarity of the electromagnet after detecting a position of the seat using a sensor as in the prior art, possibility of generating a malfunction of the device can be avoided.

Also, according to the present invention, since the power is supplied to the electromagnet only when the permanent magnet approaches, unnecessary power consumption can be reduced.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A swing device comprising:

a supporter;

a seat suspended on the supporter to swing in front and back directions;

a permanent magnet installed in the seat; and an electromagnet installed to face the permanent magnet in a swing path to have the same polarity as that of the permanent magnet, wherein the electromagnet is selectively driven when the permanent magnet approaches, generating a repulsive force for the permanent magnet, and the electromagnet includes an iron core, a primary coil wound around the iron core, a power source for supplying electric current to the primary coil, and a switching unit disposed between the primary coil and the power source so as to selectively interrupt current supply from the power source to the primary coil.

2. The swing device as claimed in claim 1, wherein the electromagnet further includes a secondary coil for generating induced current when the permanent magnet approaches so as to operate the switching unit, and one end of the secondary coil diverges into two portions each connected with the primary coil and the switching unit, and the other end of the secondary coil is connected with the power source.

3. The swing device as claimed in claim 2, wherein the switching unit is a transistor.

4. A swing device comprising:

a supporter;

a seat suspended on the supporter to swing in front and back directions;

a permanent magnet installed in the seat; and an electromagnet installed to face the permanent magnet in a swing path to have the same polarity as that of the permanent magnet, wherein the electromagnet is selectively driven when the permanent magnet approaches, generating a repulsive force for the permanent magnet, and the permanent magnet is installed in a central position under the seat, and the electromagnet is installed directly under the permanent magnet to face the same with a certain distance.

5. The swing device as claimed in claim 4, wherein the permanent magnet and the electromagnet are spaced apart from each other by a certain distance in the swing direction when the seat is positioned in a center position of a swing trajectory.

* * * * *